US006306804B1

(12) United States Patent
Harris et al.

(10) Patent No.: US 6,306,804 B1
(45) Date of Patent: Oct. 23, 2001

(54) BILGE CLEANING PRODUCT

(76) Inventors: James M. Harris, 7030 Albany Ave., Rose Haven, MD (US) 20714; Sheldon E. Broedel, Jr., 4 Prestwick Sq., Baltimore, MD (US) 21228

( * ) Notice: Subject to any disclaimer, the term of this patent is extended or adjusted under 35 U.S.C. 154(b) by 0 days.

(21) Appl. No.: 09/457,686

(22) Filed: Dec. 9, 1999

Related U.S. Application Data

(60) Provisional application No. 60/111,566, filed on Dec. 9, 1998.

(51) Int. Cl.[7] ..... C11D 7/14; C11D 7/26; C11D 17/00

(52) U.S. Cl. ..... 510/110; 510/445; 510/446; 510/447; 510/506

(58) Field of Search ..... 510/224, 120, 510/141, 445, 446, 447, 506, 110

(56) References Cited

U.S. PATENT DOCUMENTS

| | | | | |
|---|---|---|---|---|
| 3,988,255 | * | 10/1976 | Seiden | 252/107 |
| 5,705,164 | * | 1/1998 | Mackey et al. | 424/400 |
| 5,716,692 | * | 2/1998 | Warner et al. | 428/153 |
| 5,830,487 | * | 11/1998 | Klofta et al. | 424/402 |
| 6,074,998 | * | 6/2000 | He et al. | 510/155 |
| 6,114,291 | * | 9/2000 | He et al. | 510/152 |
| 6,174,845 | * | 1/2001 | Rattinger et al. | 510/146 |

* cited by examiner

*Primary Examiner*—Gregory Delcotto
(74) *Attorney, Agent, or Firm*—Dougherty & Troxell

(57) ABSTRACT

A solid phase bilge water cleaning composition which is biodegradable and environmentally safe is disclosed. The composition includes a polysorbitan monostearate wax such as polyoxyethylenesorbitan monostearate and a mixture of nonionic alkyl detergent with about 18% sodium metasilicate and about 12% chlorinated trisodium phosphate.

9 Claims, No Drawings

BILGE CLEANING PRODUCT

This application claims the benefit of an earlier filed U.S. Provisional Application Ser. No. 60/111,566 which was filed on Dec. 9, 1998.

FIELD OF THE INVENTION

This invention relates to a bilge cleaning composition and more particularly to a solid slow release bilge cleaning block for removing oil and other organic residue from the bilge of a vessel and for dispersing or preventing oil slicks when the treated bilge water is pumped overboard.

BACKGROUND FOR THE INVENTION

It is periodically necessary to clean the bilge of a vessel due to the collection of stagnant or dirty water. This stagnant or dirty water typically includes oil, gasoline and /or diesel fuel which can create hazardous conditions as well as causing particularly difficult conditions with respect to the removal thereof from the bilge. As a general rule. federal, state and local regulations prohibit pumping untreated bilge water overboard. For example. The Federal Water Pollution Control Act (FWPCA) prohibits the discharge of oil or hazardous substances into the waters within the Unites States. This prohibition is stated in terms: "discharge" includes spiking, spilling, leaking, or dumping; and "oil" means any kind of oil in any form including fuel oil, gasoline, lubricating oil and oil mixed with water in a vessel's bilge. The U.S. Coast Guard and Environmental Protection Agency standards states that oil has been discharged in a harmful quantity if it causes a visible shinning rainbow or discoloration of the surface of the water.

For this reason, it is necessary to clean a bilge and remove the treated bilge water at a discharge station. Typically, liquid cleaners are used, added to the bilge water and after a short period of time, the boat is taken to a discharge station and the treated bilge water pumped out. In the case of small boats, those having a length of 65 feet or less and one or two inboard engines, the bilge is cleaned periodically and is considered a necessary burden. For this reason, bilge cleaning is sometimes overlooked or put off which can cause additional problems.

Many of the commercially available liquid cleaners do not break down the oil or other organic materials and leave an oil film in the bilge. If the liquid cleaner leaves a residue of oil, gasoline or the like, the residue contributes to the conditions which will require a subsequent cleaning and may enhance corrosion of the materials used in manufacturing the vessel. Furthermore, some of the liquid cleaners are non-bioderadable and may further contribute to the pollution problem.

Accordingly, it is thought to be highly desirable to provide a continuous bilge cleaning product which will treat the bilge water and at the same time break down any organic residue so that it can be pumped overboard without harming the environment or violating federal, state or local regulations. It is also highly desirable to provide a bilge cleaning product that is easy to handle, facilitates bilge cleaning, and which can be manufactured and sold at a competitive price.

SUMMARY OF THE INVENTION.

The present invention contemplates an improved bilge cleaning product that is provided in solid form and which releases its active ingredients over a prolonged period of time. The product can be thrown into a bilge, is particularly simple to handle and does not require gloves or other protective clothing to handle. In fact, the cleaners can be handled with an individual's bare hands and in good clothes without concern for soiling or damaging one's clothes. Furthermore, the ordinary movement of the boat while at dock or under way provides sufficient agitation to continuously clean the bilge while allowing the boat owner to discharge the treated bilge water at his or her convenience. It is also presently believed , that the treated bilge water may be pumped overboard without violating any federal, state or local regulations. It is believed that the treated bilge water can be pumped overboard because tests show that after treatment bilge water could be pumped overboard without leaving a visible shinning rainbow or discoloration on the surface of the water.

In addition, the bilge cleaning compositions in accordance with the invention are highly effective with mixtures of saline or hard water and oil or other hydrocarbons. Furthermore the preferred embodiment of the invention has less than 5% phosphates and is believed to be environmentally safe. Such compositions can be manufactured and sold at a competitive price and do not present a problem with foaming. Further advantages of such compositions relate to the solid slow release properties which provide continuous cleaning action due to the movement of the vessel. Because of the slow release properties, it is believed that it may be possible to add a small block or "pill" of the composition to the bilge on a once a month basis and to pump out the bilge water over the same period on an as needed basis. The frequency of adding additional composition will, of course, depend on the condition of the vessel and its use.

In essence, the present invention contemplates a solid phase bilge water cleaning composition which is biodegradable and environmentally safe. The composition comprises a polysorbitan monostearate wax in an amount of 30–70% by weight, preferably a polyethylene sorbitan monstearate wax and about 30–70% by weight of a second compound selected from the group consisting of a) a non-ionic alkyl detergent, b) sodium citrate, c) sodium metasilicate, d) a sorbitan monostearate, e) a fatty alcohol ethoxylate polyoxyethylene stearyl ether and mixtures thereof. In the preferred embodiment of the invention, the composition includes about 50% by weight polyoxyethylene sorbitan monostearate and about 50% by weight of a mixture of non-ionic alkyl detergent with about 18% sodium metasilicate and about 12% trisodium phosphate.

DESCRIPTION OF THE PREFERRED EMBODIMENTS OF THE INVENTION.

A solid phase bilge water cleaning composition in accordance with a preferred embodiment of the invention includes a biodegradable detergent and an emulsifier that is environmentally safe. The preferred composition includes about 50 % by weight of 95% pure polyoxyethylenesorbitan monostearate such as Tween 61 which is available from ICI Americas of Wilmington, Del. The Tween 61 is combined with a second surfactant, which makes up the other 50% by weight of the composition. The second surfactant is preferably a non-ionic alkyl detergent with 18% sodium metasilicate and 12% trisodium phosphate. This material is available from Pierce Chemical of (city, State) and is Identified as RBS-35. This combination has been found to be a particularly effective surfactant for use in cleaning bilges. The effectiveness of the composition of this invention in such usually adverse conditions for surfactants is quite good.

Another advantage of the compositions of this invention is its low foaming properties. One of the purposes of this invention is to maintain the environment and the scenic beauty of the bodies of water. Accordingly, it is desirable to avoid excessive foaming. It is also highly desirable to minimize in so far as practical the amount of phosphates in the composition. Accordingly, in the preferred embodiment of the invention, the phosphates have been reduced to less than 5% of the total composition. This level is believed to be within the guidelines of the Environmental Protection Agency.

A solid slow release bilge cleaning composition in accordance with one embodiment of the invention can be made by melting 12.75 pounds of Tween 61 wax at about 60–80° C. in a stainless steel vessel. An equal amount of RBS-35 is then blended into the Tween 61 wax with mechanical stirring until a homogenous mixture is obtained. The mixture is then poured into a warmed tray with 100 mold cavities and allowed to cool at room temperature for about 4 hours. Curing is then completed by chilling the tray at about −20° C. over night. The mold braces are then removed and the finished product stored in a dry environment at temperatures of less than 90° F.

Field trials have indicated that a 4 oz. block is ideal for average vessels that is between about 20 and 45 feet. Accordingly, the Bilge Pill(s)™ should be made in a size of 2.22cubic inches. For circular products, the molds would be 2 7/16 inches in diameter and 1 inch high while rectangular molds would be 2 7/16×2 7/16 by 1 inch. For larger runs an extrusion process is contemplated.

Two types of tests were performed to test the effectiveness of the compositions according to the present invention. First an efficacy test was run on various formulations for their performance in solubilizing oil. In this test, 10 ml of sea water with 0.2 ml of spent 10W30 motor oil and samples of bilge water contaminated with a petroleum mixture were added to a flask, 0.5g. of the cleaning composition was then added and the flasks incubated at 25° while being rotated at 150 rpm. After 15 min. of incubation, the oil layer was completely dissolved and remained dissolved for several days when the experiment was terminated. To further asses efficacy, a cake of 28g.(1 oz.) of a cake, made in accordance with the preferred embodiment of the invention, was placed in ajar containing contaminated bilge water and the jar shaken for 15 min. at 150 rpm. After 15 min., the oil was completely emulsified and remained so indefinitely.

The second type of test, the field test was performed by using 4, 2. and 1 oz. blocks of the bilge cleaning compositions were placed in the bilge of boats ranging in size from 25 to 40 ft. The bilges each contained between about 2 and 10 gallons. Efficacy was measured by visual inspection and the criteria for success was removal of more than 90%of the visible petroleum.

The following examples show various compositions which were satisfactory.

| Example 1 | |
|---|---|
| Tween 61 | 60% |
| Sodium metasilicate | 10% |
| Sodium citrate | 30% |
| **Example 2** | |
| Tween 61 | 60% |
| Sodium metasilicate | 20% |
| Sodium citrate | 20% |

-continued

| Example 3 | |
|---|---|
| Tween 61 | 60% |
| Sodium metasilicate | 30% |
| Sodium citrate | 10% |
| **Example 4** | |
| Tween 61 | 60% |
| Sodium metasilicate | 40% |
| **Example 5** | |
| Tween 61 | 70% |
| RBS 35 | 30% |
| **Example 6** | |
| Span 60 | 20% |
| Volpo CS-10 | 30% |
| RBS 35 | 50% |

Span 60 is a sorbitan monostearate which is available from ICI Americas Inc of Wilmington, Del. and Volpo CS-10 is a fatty alcohol ethoxylate poloxyethylene Stearyl ether which is available from Croda, Inc. of Parsippany, N.J.

The aforementioned mixes may be compounded in various amounts or contain additional materials in order to adjust the rate of release of the effective components and for variations in salinity. The compounds may also include perfumes or other odor enhancing compounds as will be well understood by persons of ordinary skill in the art. In addition, it is also contemplated that suitable dyes may be added to the center of the block as an indication that it is time to add another block of the solid bilge cleaning composition to the bilge.

While the invention has been described in connection with its preferred embodiments, it should be recognized that changes and modifications may be made without departing from the scope of the appended claims.

What is claimed is:

1. A solid slow release bilge cleaning composition which includes polyethylene sorbitan monostearate wax in an amount of 30–70% by weight and between about 30–70% by weight of a compound selected from the group consisting of a) a non-ionic alkyl detergent, wherein the nonionic alkyl detergent contains about 18% by weight sodium metasilicate and about 12% by weight trisodium phosphate b) sodium citrate, c) sodium metasilicate, d) a sorbitan monostearate, e) a fatty alcohol ethoxylate polyoxyethylene stearyl ether and mixtures thereof.

2. A solid slow release bilge cleaning composition according to claim 1 which includes about 60% by weight polyethylenesorbitan monostearate wax.

3. A solid slow release bilge cleaning composition according to claim 2 which includes about 10% by weight sodium metasilicate and about 30% by weight sodium citrate.

4. A solid slow release bilge cleaning composition according to claim 2 which includes about 20% by weight sodium metasilicate and about 20% by weight sodium citrate.

5. A solid slow release bilge cleaning composition according to claim 2 which includes about 30% by weight sodium metasilicate and about 10% by weight sodium citrate.

6. A solid slow release bilge cleaning composition according to claim 2 which includes about 40% by weight sodium metasilicate.

7. A solid slow release bilge cleaning composition according to claim 1 wherein the bilge cleaning composition includes about 70% by weight polyethylene sorbitan monostearate wax.

8. A solid slow release bilge cleaning composition according to claim 1 which includes about 50% by weight polyethylene sorbitan monostearate wax.

9. A solid slow release bilge cleaning composition according to claim 8 which includes a dye added at the center of the solid composition as an indication that it is time to add additional solid slow release cleaning composition to the bilge.

* * * * *